US007574751B2

(12) United States Patent
Barreiro

(10) Patent No.: US 7,574,751 B2
(45) Date of Patent: Aug. 18, 2009

(54) COMBINED MULTI-PERSON AND WHEELCHAIR PROTECTIVE COVERING AND ASSOCIATED METHOD

(76) Inventor: Katherine Barreiro, 505 La Guardia Pl., Apartment 19 F, New York, NY (US) 10012-2004

( * ) Notice: Subject to any disclaimer, the term of this patent is extended or adjusted under 35 U.S.C. 154(b) by 43 days.

(21) Appl. No.: 11/881,709

(22) Filed: Jul. 27, 2007

(65) Prior Publication Data

US 2008/0307555 A1 Dec. 18, 2008

Related U.S. Application Data

(60) Provisional application No. 60/934,357, filed on Jul. 31, 2006.

(51) Int. Cl.
*A41D 3/00* (2006.01)

(52) U.S. Cl. ..... 2/88; 2/84

(58) Field of Classification Search ..... 2/69, 2/69.5, 88, 84, 80, 85, 83, 94–96, 108, 105, 2/106, 113–115
See application file for complete search history.

(56) References Cited

U.S. PATENT DOCUMENTS 12,170 A * 1/1855 Crimins ..... 83/780
1,802,807 A * 4/1931 Davis ..... 296/81
3,676,879 A * 7/1972 Irie ..... 2/202
4,118,802 A 10/1978 Polster
4,535,479 A * 8/1985 Paula ..... 2/69.5
4,975,985 A * 12/1990 Stimpson ..... 2/115
5,005,235 A * 4/1991 Huang ..... 5/413 R
5,056,160 A * 10/1991 Buchanan ..... 2/88
5,168,579 A 12/1992 Marshall
5,437,061 A * 8/1995 Kenner ..... 2/69
5,452,476 A 9/1995 Jenks
5,592,691 A * 1/1997 Ronald ..... 2/69
5,657,489 A * 8/1997 Ponstein ..... 2/69
6,161,223 A * 12/2000 Andrews ..... 2/234
6,349,411 B1 * 2/2002 Tyler ..... 2/69
7,458,104 B1 * 12/2008 Garcia ..... 2/69.5

* cited by examiner

*Primary Examiner*—Gloria Hale

(57) ABSTRACT

A combination multiple person and wheelchair protective covering includes first and second coextensively shaped ponchos. Such first and second ponchos are formed from water repellant material such that precipitation is prohibited from penetrating therethrough. The apparatus further includes a mechanism for removably attaching the second poncho to the first poncho, a mechanism for adjusting each of the first and second ponchos about the user head and the caregiver head respectively, and a mechanism for simultaneously securing each of the first and second ponchos respectively about the user body and the caregiver body and the existing wheelchair respectively during operating conditions.

16 Claims, 5 Drawing Sheets

COMBINED MULTI-PERSON AND WHEELCHAIR PROTECTIVE COVERING AND ASSOCIATED METHOD

CROSS REFERENCE TO RELATED APPLICATIONS

This application claims the benefit of U.S. Provisional Application No. 60/934,357, filed Jul. 31, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to garment coverings and, more particularly, to a combined multi-person and wheelchair protective covering for allowing a user and a caretaker to employ an existing wheelchair in outdoor environments during inclement weather.

2. Prior Art

Wheelchairs and motorized scooters are extremely practical devices which enable those with limited mobility to get from one place to another in a simple and comfortable manner. For most who depend on wheelchairs and motorized scooters, these devices are necessary regardless of whether spending time indoors or out. In fact, many who suffer limited mobility lead very active lives and enjoy participating in various outdoor sports or recreational activities. As with anyone else, consumers who depend on wheelchairs or scooters are often caught in inclement weather and find it necessary to seek protection from the elements by utilizing an umbrella. Used to protect outdoor revelers from pouring rain, driving sleet and falling snow, the open canopy of an umbrella is also utilized by those who are concerned with the dangers of over exposure to the sun.

Unfortunately, actually holding onto an umbrella can present a challenge for those who suffer limited mobility, simply because they lack the manual dexterity to firmly grip the umbrella's handle. For those who do have use of their arms or hands, the problem is not so much holding onto the umbrella, but rather holding onto the umbrella while attempting to operate their chair. This problem can be particularly vexing if already attempting to juggle a portfolio, briefcase, or even a few shopping bags when operating one's chair. Let's face it, getting soaked by an unexpected downpour, simply because one did not have a hand free to hold an umbrella over their head, can be completely frustrating. Not limited to the wheelchair bound consumer, for those in a wheelchair who are dependent on a caregiver, an unexpected rain storm can result in both parties becoming soaked. Obviously, it would be advantageous to provide a means for effectively covering a wheelchair bound individual and their caregiver during inclement weather conditions.

U.S. Pat. No. 5,168,889 to Diestel discloses a simple removable and storable weather and sun covering for a wheelchair. Two embodiments include a soft cover version which can be dismantled and stowed in a container on the wheelchair, and a hard top version which can be easily removed and stored when not needed. Common to both covers is a cover support clamp bracket uniquely suited for securing a variety of covers and cover frames to the frame of most any wheelchair. The cover support clamp bracket can be left on the wheelchair even when not in use or easily removed when not needed. A tubular extension fitting the clamping bracket increases wheelchair cover stability. No special frame work retainers are required in the framework of the soft cover. Unfortunately, this prior art example does not provide a means for covering both a user and a user's companion.

U.S. Pat. No. 4,924,896 to Carter discloses a collapsible canopy for use with a chair or other free-standing device. The collapsible canopy of the present invention includes three hoop sections which are covered with a material capable of blocking substantial amounts of sunlight. The respective hoop sections are coupled with a cross-coupled truss structure which extends to support the collapsible canopy over a chair or other freestanding device in an open position, and collapses to store the collapsible canopy in an extremely compact form in a closed position. Unfortunately, this prior art example is not designed for a user of a wheel chair in movement.

U.S. Pat. No. 4,389,057 to Richard discloses a transparent cover that is attached to a wheelchair for protecting the user of the wheelchair from adverse weather conditions and the like. The cover includes a number of clear panels attached to a frame. The frame is removably attached to the wheelchair. Unfortunately, this prior art example does not provide a means for covering both a user and a user's companion.

Accordingly, the present invention is disclosed in order to overcome the prior art shortcomings. The present invention satisfies such a need by providing an apparatus that is convenient and easy to use, lightweight yet durable in design, and designed for providing a barrier between the sun and precipitation and a user thereby allowing the user and a caretaker to employ an existing wheelchair in outdoor environments during inclement weather. The combination multiple person and wheelchair cover is specifically designed for users in a wheelchair, and provides protection both for the user and the user's companion. The apparatus conveniently provides a user a hands-free method for shielding themselves from inclement weather, and is appropriately sized to drape over the wheelchair user as well as anyone standing behind the chair. The present invention is simple to use, inexpensive, and designed for many years of repeated use.

BRIEF SUMMARY OF THE INVENTION

In view of the foregoing background, it is therefore an object of the present invention to provide a means for providing a barrier between the sun and precipitation and a user thereby allowing the user and a caretaker to employ an existing wheelchair in outdoor environments during inclement weather. These and other objects, features, and advantages of the invention are provided by a combination multiple person and wheelchair cover.

A combination multiple person and wheelchair protective covering includes first and second coextensively shaped ponchos. Such first and second ponchos are formed from water repellant material such that precipitation is prohibited from penetrating therethrough. Each of the first and second ponchos includes a substantially square-shaped and flexible planar body and an annular opening formed in a central region of a top surface of the body. Such an opening is suitably sized such that the user head and the caregiver head respectively removably penetrate therethrough during operating conditions. Such a body is effectively draped about the user shoulders and the caregiver shoulders respectively, extending downwardly and outwardly therefrom.

The first and second ponchos further include a flexible hooded portion monolithically formed with a rear edge of the annular opening. Such a hooded portion conveniently extends upwardly and away from the top surface of the body, and the hooded portion is suitably shaped and sized such that the user head and the caregiver head respectively is introduced into an interior thereof. The hooded portion simultaneously contacts and surrounds a major portion of the top, sides, and back respectively of the user head and the caregiver head respectively during operating conditions.

The apparatus further includes a mechanism for removably attaching the second poncho to the first poncho. Such a removably attaching mechanism includes a plurality of snap closures equidistantly spaced along a rear edge of the first poncho and a front edge of the second poncho respectively. Each of such snap closures of the first poncho is directly connected to an associated one of the snap closures of the second poncho such that the first and the second ponchos respectively are prohibited from prematurely and undesirably separating during operating conditions.

The apparatus further includes a mechanism for adjusting each of the first and second ponchos about the user head and the caregiver head respectively. Such an adjusting mechanism includes a sleeve monolithically formed in a front edge of each of the hooded portions. Such a sleeve advantageously extends along an entire length of the front edge of the hooded portion. The adjusting mechanism further includes a drawstring slidably interfitted within the sleeve of the hooded portion, and the drawstring has a longitudinal length that is greater than a longitudinal length of the sleeve of the hooded portion. The drawstring is for effectively tightening the hooded portion about the user head and the caregiver head respectively during operating conditions.

The apparatus further includes a mechanism for simultaneously securing each of the first and second ponchos respectively about the user body and the caregiver body and the existing wheelchair respectively during operating conditions. Such a securing mechanism conveniently includes a plurality of snap closures equidistantly spaced along respective right and left laterally opposed edges of the first and second ponchos. Selected ones of such left snap closures of the first poncho are directly connected to associated ones of the left snap closures of the first poncho while selected ones of the right snap closures of the first poncho are independently and directly connected to associated ones of the right snap closures of the first poncho and selected ones of the left snap closures of the second poncho are directly connected to associated ones of the left snap closures of the second poncho while the right snap closures of the second poncho are independently and directly connected to associated ones of the right snap closures of the second poncho.

The user and the caregiver respectively connect the right and left snap closures respectively as desired about the user and the caregiver and the existing wheelchair respectively to advantageously prohibit sun and precipitation from contacting the user and the caregiver and the existing wheelchair respectively during operating conditions.

A method for providing a barrier between the sun and precipitation and a user includes the step of providing first and second coextensively shaped ponchos. Such first and second ponchos are formed from water repellant material such that precipitation is prohibited from penetrating therethrough. The steps further include attaching the second poncho to the first poncho, adjusting each of the first and second ponchos about the user head and the caregiver head respectively, and securing each of the first and second ponchos respectively about the user body and the caregiver body and the existing wheelchair respectively during operating conditions.

The method further includes the step of providing the first and second ponchos respectively. Each of such first and second ponchos respectively has a substantially square-shaped and flexible planar body. The steps further include providing an annular opening formed in a central region of a top surface of the body of the first and second ponchos respectively, penetrating the user head and the caregiver head respectively through the openings of the body of the first and second ponchos respectively, and draping the body about the user shoulders and the caregiver shoulders respectively. The body extends downwardly and outwardly therefrom.

The steps further include providing a flexible hooded portion monolithically formed with a rear edge of the annular openings of the first and second ponchos respectively. Such a hooded portion extends upwardly and away from the top surface of the body of the first and second ponchos respectively. The steps further include introducing the user head and the caregiver head respectively into an interior of the hooded portion. Such a hooded portion simultaneously contacts and surrounds a major portion of the top, sides, and back respectively of the user head and the caregiver head respectively during operating conditions.

The method further includes the steps of providing a plurality of snap closures equidistantly spaced along a rear edge of the first poncho and a front edge of the second poncho respectively and connecting each of the snap closures of the first poncho directly to an associated one of the snap closures of the second poncho such that the first and the second ponchos respectively are prohibited from prematurely and undesirably separating during operating conditions.

The method further includes the steps of providing a sleeve monolithically formed in a front edge of each of the hooded portions. Such a sleeve extends along an entire length of the front edge of the hooded portion. The steps further include interfitting a drawstring within the sleeve of the hooded portion. Such a drawstring has a longitudinal length that is greater than a longitudinal length of the sleeve of the hooded portion. The steps further include tightening the drawstring of the hooded portion about the user head and the caregiver head respectively during operating conditions.

The method further includes the steps of: providing a plurality of snap closures equidistantly spaced along respective right and left laterally opposed edges of the first and second ponchos, connecting selected ones of the left snap closures of the first poncho directly to associated ones of the left snap closures of the first poncho, connecting selected ones of the right snap closures of the first poncho independently and directly to associated ones of the right snap closures of the first poncho, connecting selected ones of the left snap closures of the second poncho directly to associated ones of the left snap closures of the second poncho, and connecting the right snap closures of the second poncho independently and directly to associated ones of the right snap closures of the second poncho.

There has thus been outlined, rather broadly, the more important features of the invention in order that the detailed description thereof that follows may be better understood, and in order that the present contribution to the art may be better appreciated. There are additional features of the invention that will be described hereinafter and which Will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
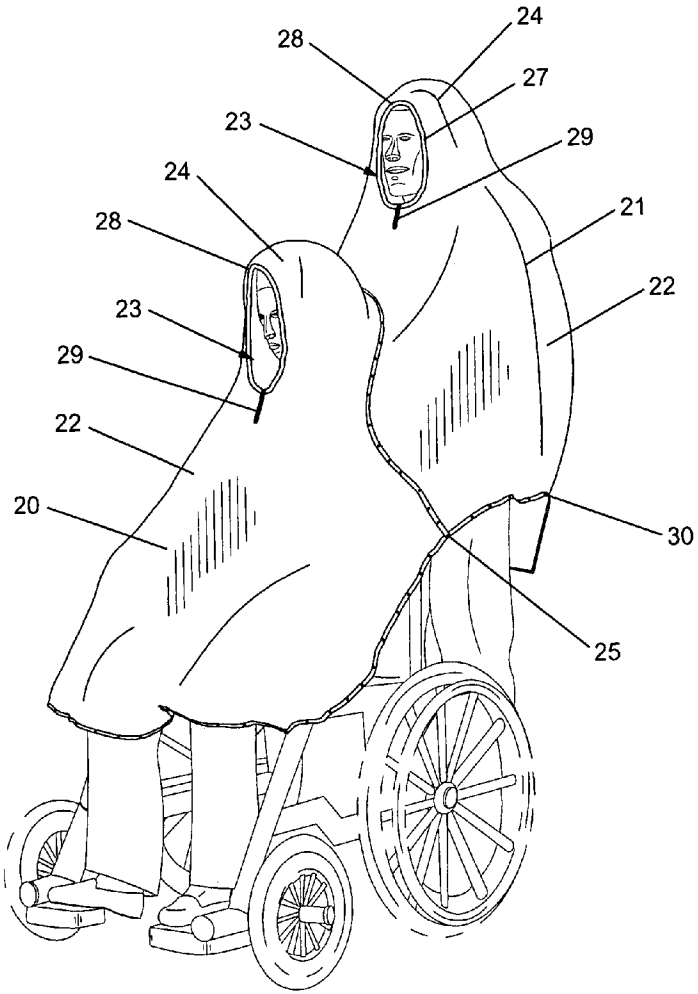
FIG. 1 is a perspective view showing a combined multi-person and wheelchair protective covering in use, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a means for providing a barrier between the sun and precipitation and a user thereby allowing the user and a caretaker to employ an existing wheelchair in outdoor environments during inclement weather. It should be understood that the apparatus 10 may be used to shield many different types of chairs and users and should not be limited to shielding only those types of chairs mentioned herein.

Referring initially to FIGS. 1, 2, 3, 4 and 5, a combination multiple person and wheelchair protective covering includes first and second coextensively shaped ponchos 20, 21. Such first and second ponchos 20, 21 are formed from water repellant material such that precipitation is prohibited from penetrating therethrough. Each of the first and second ponchos 20, 21 includes a substantially square-shaped and flexible planar body 22 and an annular opening 23 formed in a central region of a top surface of the body 22. Such an opening 23 is suitably sized which is essential such that the user head and the caregiver head respectively removably penetrate therethrough during operating conditions. Such a body 22 is draped about the user shoulders and the caregiver shoulders respectively, extending downwardly and outwardly therefrom. The first and second ponchos provide an effective means for shielding both a wheelchair user and a user companion from rain or sun.

The first and second ponchos further include a flexible hooded portion 24 monolithically formed with a rear edge of the annular opening 23. Such a hooded portion 24 extends upwardly and away from the top surface of the body 22, and the hooded portion 24 is suitably shaped and sized which is vital such that the user head and the caregiver head respectively is introduced into an interior thereof. The hooded portion 24 simultaneously contacts and surrounds a major portion of the top, sides, and back respectively of the user head and the caregiver head respectively during operating conditions. The hooded portion provides shelter for a user head.

Referring to FIGS. 1, 2, 4 and 5, the apparatus further includes a mechanism for removably attaching the second poncho to the first poncho. Such a removably attaching mechanism 25 includes a plurality of snap closures 26 equidistantly spaced along a rear edge of the first poncho 20 and a front edge of the second poncho 21 respectively. Each of such snap closures 26 of the first poncho 20 is directly connected, without the use of intervening characters, to an associated one of the snap closures 26 of the second poncho 21 such that the first and the second ponchos respectively are prohibited from prematurely and undesirably separating during operating conditions. The removably attaching mechanism may also include buttons, tie-downs, and zippers, etc. The removably attaching mechanism secures the ponchos tightly against a user, thereby preventing the poncho from being permeated by rain or sun.

Figure 2:
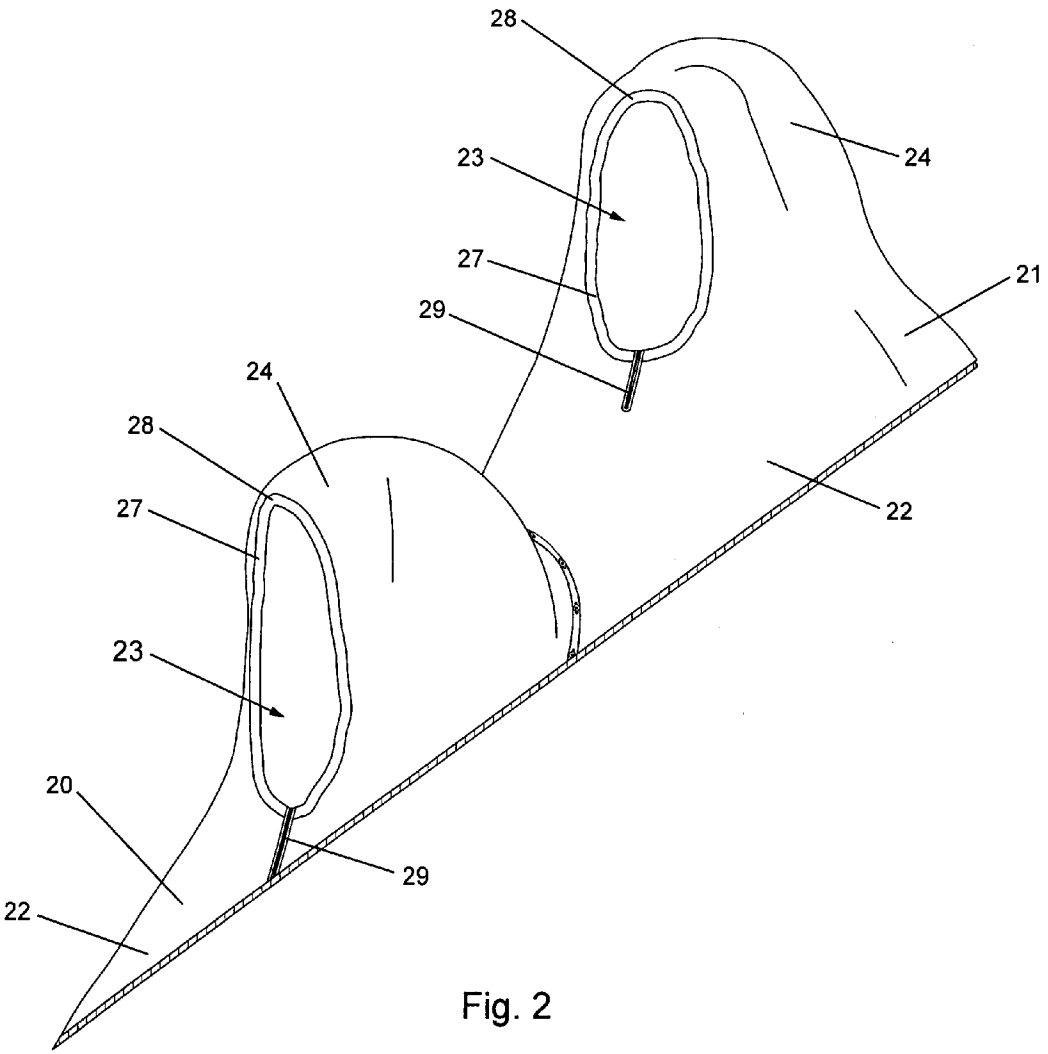
FIG. 2 is a perspective view of the hooded portions of the first and second ponchos, in accordance with the present invention.
Figure 3:
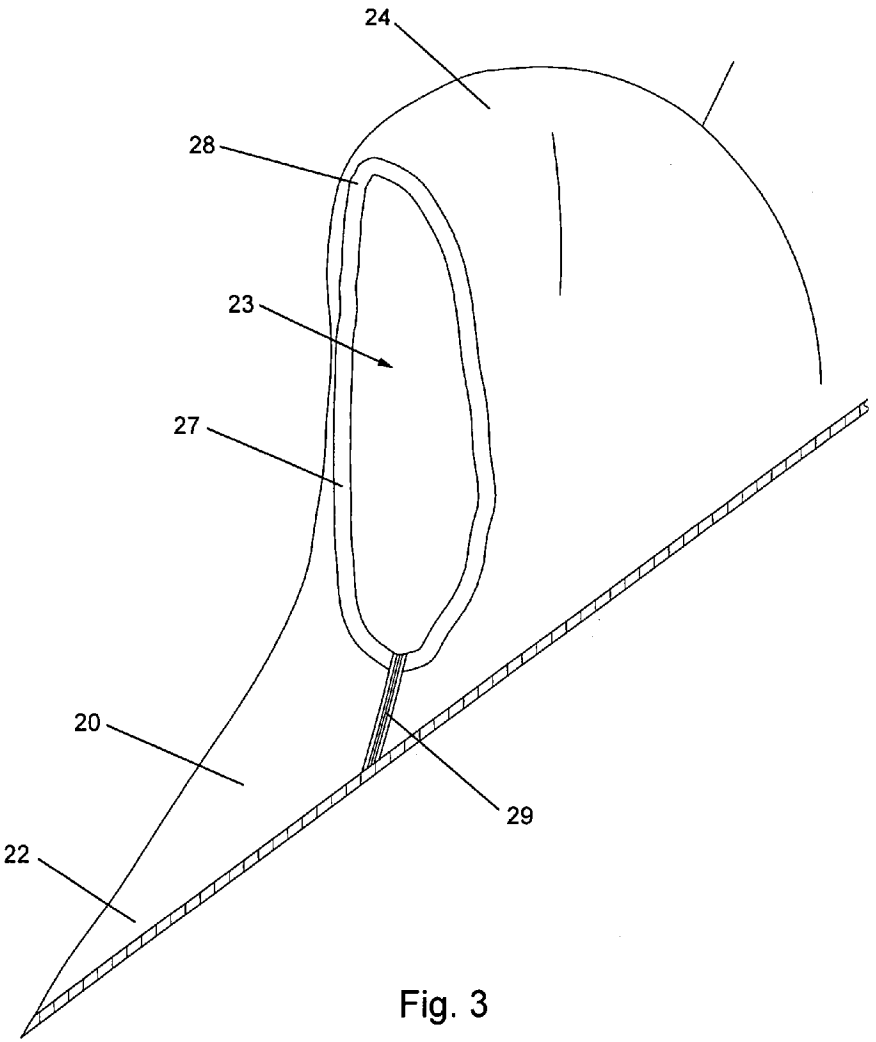
FIG. 3 is a is an enlarged view of the adjusting mechanism, in accordance with the present invention.

Referring to FIGS. 1, 2 and 3, the apparatus further includes a mechanism for adjusting each of the first and second ponchos about the user head and the caregiver head respectively. Such an adjusting mechanism 27 includes a sleeve 28 monolithically formed in a front edge of each of the hooded portions 24. Such a sleeve 28 extends along an entire length of the front edge of the hooded portion 24. The adjusting mechanism 27 further includes a drawstring 29 slidably interfitted within the sleeve 28 of the hooded portion 24, and the drawstring 29 has a longitudinal length that is greater than a longitudinal length of the sleeve 28 of the hooded portion 24. The drawstring 29 is for tightening the hooded portion 24 about the user head and the caregiver head respectively during operating conditions. Such an adjusting mechanism provides a means for tightening the hood in weather conditions of high wind, thereby ensuring that the hood remains in place and protects a user face.

Figure 4:
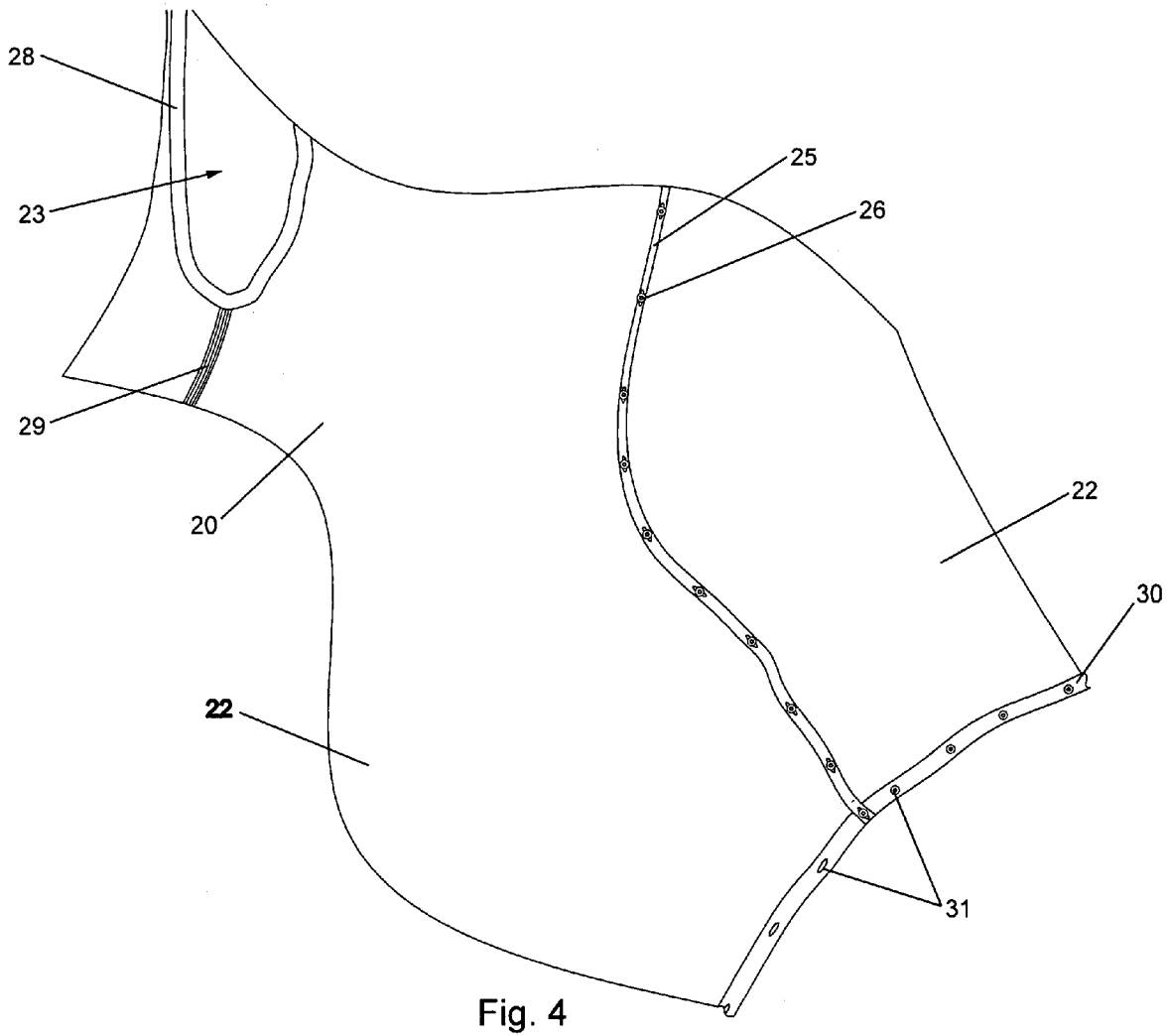
FIG. 4 is an enlarged view of the removably attaching mechanism, in accordance with the present invention.
Figure 5:
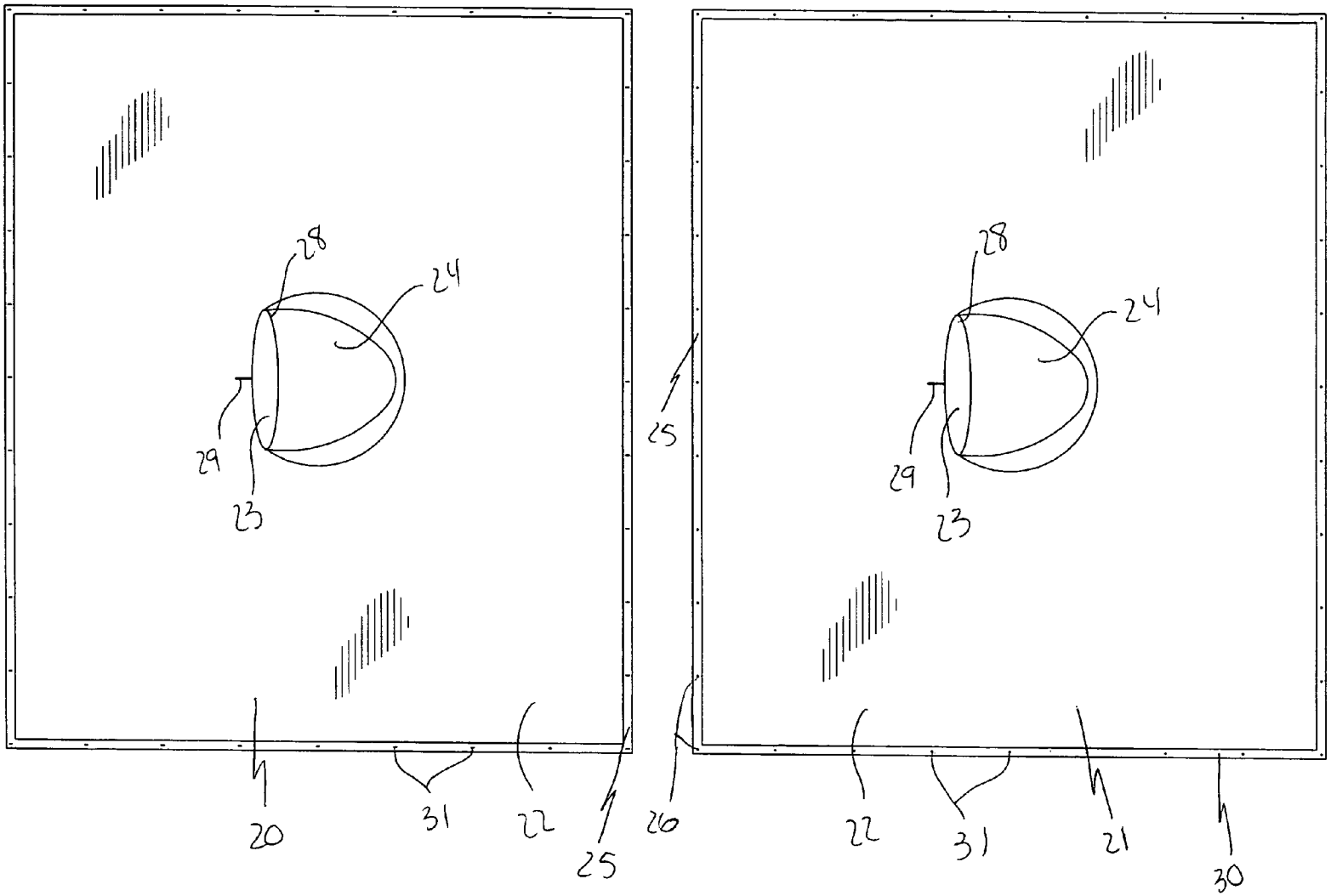
FIG. 5 is a top planar view of the present invention.

Referring to FIGS. 1 and 4, the apparatus further includes a mechanism for simultaneously securing each of the first and second ponchos respectively about the user body and the caregiver body and the existing wheelchair respectively during operating conditions. Such a securing mechanism 30 includes a plurality of snap closures 31 equidistantly spaced along respective right and left laterally opposed edges of the first and second ponchos 20, 21. Selected ones of such left snap closures 31 of the first poncho 20 are directly connected, without the use of intervening characters, to associated ones of the left snap closures 31 of the first poncho 20 while selected ones of the right snap closures 31 of the first poncho 20 are independently and directly connected, without the use of intervening characters, to associated ones of the right snap closures 31 of the first poncho 20 and selected ones of the left snap closures 31 of the second poncho 21 are directly connected to associated ones of the left snap closures of the second poncho while the right snap closures of the second poncho are independently and directly connected to associated ones of the right snap closures of the second poncho.

Notably, selected ones of the snap closures 31 are male members and other ones of the snap closures are female members such that the first 20 and second 21 ponchos can be removably connected to each other along respective bottom edges thereof. The securing mechanism allows the two ponchos to be secured together, thereby allowing a wheelchair user and user companion to move easily while both being shielded from the weather.

The user and the caregiver respectively connect the right and left snap closures respectively as desired about the user and the caregiver and the existing wheelchair respectively to prohibit sun and precipitation from contacting the user and the caregiver and the existing wheelchair respectively during operating conditions.

The two ponchos provide the unexpected benefit of allowing both a wheelchair user and a user companion to be shielded against inclement weather while also still being able to move simultaneously. In addition, the hood provides the unexpected benefit of shielding a user face. Also, the securing mechanism allows the ponchos to be used together or separately. Such benefits overcome the prior art shortcomings.

In use, the apparatus is simple and straightforward to use. First, a user purchases a poncho according to personal preferences. Then, the two ponchos are secured together using the snap closures. When inclement weather arises, a user need only to adjust the hood and side snaps for a comfortable and secure fit. The poncho will also cover either side of the wheelchair.

In use, a method for providing a barrier between the sun and precipitation and a user includes the step of providing first and second coextensively shaped ponchos 20, 21. Such first and second ponchos 20, 21 are formed from water repellant material such that precipitation is prohibited from penetrating therethrough. The steps further include attaching the second poncho 21 to the first poncho 20, adjusting each of the first and second ponchos 20, 21 about the user head and the caregiver head respectively, and securing each of the first and second ponchos respectively about the user body and the caregiver body and the existing wheelchair respectively during operating conditions.

In use, the method further includes the step of providing the first and second ponchos respectively. Each of such first and second ponchos 20, 21 respectively has a substantially square-shaped and flexible planar body 22. The steps further include providing an annular opening 23 formed in a central region of a top surface of the body 22 of the first and second ponchos 20, 21 respectively, penetrating the user head and the caregiver head respectively through the openings 23 of the body 22 of the first and second ponchos 20, 21 respectively, and draping the body 22 about the user shoulders and the caregiver shoulders respectively. The body 22 extends downwardly and outwardly therefrom.

In use, the steps further include providing a flexible hooded portion 24 monolithically formed with a rear edge of the annular openings 23 of the first and second ponchos 20, 21 respectively. Such a hooded portion 24 extends upwardly and away from the top surface of the body 22 of the first and second ponchos respectively. The steps further include introducing the user head and the caregiver head respectively into an interior of the hooded portion 24. Such a hooded portion simultaneously contacts and surrounds a major portion of the top, sides, and back respectively of the user head and the caregiver head respectively during operating conditions.

In use, the method further includes the steps of providing a plurality of snap closures 26 equidistantly spaced along a rear edge of the first poncho 20 and a front edge of the second poncho 21 respectively and connecting each of the snap closures 26 of the first poncho directly to an associated one of the snap closures of the second poncho such that the first and the second ponchos respectively are prohibited from prematurely and undesirably separating during operating conditions.

In use, the method further includes the steps of providing a sleeve 28 monolithically formed in a front edge of each of the hooded portions 24. Such a sleeve 28 extends along an entire length of the front edge of the hooded portion 24. The steps further include interfitting a drawstring 29 within the sleeve 28 of the hooded portion 24. Such a drawstring 29 has a longitudinal length that is greater than a longitudinal length of the sleeve 28 of the hooded portion 24. The steps further include tightening the drawstring 29 of the hooded portion 24 about the user head and the caregiver head respectively during operating conditions.

In use, the method further includes the steps of providing a plurality of snap closures 31 equidistantly spaced along respective right and left laterally opposed edges of the first and second ponchos 20, 21, connecting selected ones of the left snap closures of the first poncho directly to associated ones of the left snap closures of the first poncho, connecting selected ones of the right snap closures of the first poncho independently and directly to, without the use of intervening characters, associated ones of the right snap closures of the first poncho, connecting selected ones of the left snap closures of the second poncho directly to, without the use of intervening characters, associated ones of the left snap closures of the second poncho, and connecting the right snap closures of the second poncho independently and directly to, without the use of intervening characters, associated ones of the right snap closures of the second poncho.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined multi-person and wheelchair protective covering for allowing a user and a caretaker to employ an existing wheelchair in outdoor environments during inclement weather, said combined multi-person and wheelchair protective covering comprising:

first and second ponchos;

means for removably attaching said second poncho to said first poncho;

means for adjusting each of said first and second ponchos about respective heads of the user and the caregiver; and means for simultaneously securing each of said first and second ponchos about respective bodies of the user and the caregiver and the existing wheelchair during operating conditions;

wherein each of said first and second ponchos comprises a flexible body;

an annular opening formed in a central region of a top surface of said body, said opening being suitably sized such that the user head and the caregiver head respectively penetrate therethrough during operating conditions, said body being draped about respective shoulders of the user and the caregiver such that said body extends downwardly and outwardly therefrom; and a flexible hooded portion monolithically formed with a rear edge of said annular opening, said hooded portion extending upwardly and away from said top surface of said body, said hooded portion being suitably shaped and sized such that the user and caregiver heads are introduced into an interior of said hooded portion, said hooded portion simultaneously contacting and surrounding a major portion of a top portion, side portions, and a back portion of the user head and the caregiver head respectively during operating conditions;

wherein said removably attaching means and said adjusting means are independently and simultaneously adjustable.

2. The combined multi-person and wheelchair protective covering of claim 1, wherein said removably attaching means comprises:

a plurality of snap closures spaced along a rear edge of said first poncho and a front edge of said second poncho respectively, each of said snap closures of said first poncho being directly connected to an associated one of said snap closures of said second poncho such that said first and said second ponchos are prohibited from prematurely and undesirably separating during operating conditions.

3. The combined multi-person and wheelchair protective covering of claim 2, wherein said adjusting means comprises:

a sleeve monolithically formed in a front edge of each of said hooded portions, said sleeve extending along an entire length of said front edge of said hooded portion.

4. The combined multi-person and wheelchair protective covering combination protective covering of claim 3, wherein said adjusting means further comprises:

a drawstring slidably interfitted within said sleeve of said hooded portion, said drawstring having a longitudinal length that is greater than a longitudinal length of said sleeve of said hooded portion, said drawstring for tightening said hooded portion about the user head and the caregiver head respectively during operating conditions.

5. The combined multi-person and wheelchair protective covering of claim 4, wherein said securing means comprises:

a plurality of snap closures spaced along laterally opposed right and left edges of said first and second ponchos;

wherein selected ones of said left snap closures of said first poncho are directly connected to associated ones of said left snap closures of said first poncho while selected ones of said right snap closures of said first poncho are independently and directly connected to associated ones of said right snap closures of said first poncho and selected ones of said left snap closures of said second poncho are directly connected to associated ones of said left snap closures of said second poncho while said right snap closures of said second poncho are independently and directly connected to associated ones of said right snap closures of said second poncho.

6. A combined multi-person and wheelchair protective covering for allowing a user and a caretaker to employ an existing wheelchair in outdoor environments during inclement weather, said combined multi-person and wheelchair protective covering comprising:

first and second ponchos, said first and second ponchos being formed from water repellant material such that precipitation is prohibited from penetrating therethrough;

means for removably attaching said second poncho to said first poncho;

means for adjusting each of said first and second ponchos about respective heads of the user and the caregiver; and means for simultaneously securing each of said first and second ponchos about respective bodies of the user and the caregiver and the existing wheelchair during operating conditions;

wherein said securing means comprises a plurality of snap closures spaced along laterally opposed right and left edges of said first and second ponchos;

wherein selected ones of said left snap closures of said first poncho are directly connected to associated ones of said left snap closures of said first poncho while selected ones of said right snap closures of said first poncho are independently and directly connected to associated ones of said right snap closures of said first poncho and selected ones of said left snap closures of said second poncho are directly connected to associated ones of said left snap closures of said second poncho while said right snap closures of said second poncho are independently and directly connected to associated ones of said right snap closures of said second poncho.

7. The combined multi-person and wheelchair protective covering of claim 6, wherein each of said first and second ponchos comprises:

a flexible body;

an annular opening formed in a central region of a top surface of said body, said opening being suitably sized such that the user head and the caregiver head respectively penetrate therethrough during operating conditions, said body being draped about respective shoulders of the user and the caregiver such that said body extends downwardly and outwardly therefrom; and a flexible hooded portion monolithically formed with a rear edge of said annular opening, said hooded portion extending upwardly and away from said top surface of said body, said hooded portion being suitably shaped and sized such that the user and caregiver heads are introduced into an interior of said hooded portion, said hooded portion simultaneously contacting and surrounding a major portion of a top portion, side portions, and a back portion of the user head and the caregiver head respectively during operating conditions.

8. The combined multi-person and wheelchair protective covering of claim 7, wherein said removably attaching means comprises:

a plurality of snap closures spaced along a rear edge of said first poncho and a front edge of said second poncho respectively, each of said snap closures of said first poncho being directly connected to an associated one of said snap closures of said second poncho such that said first and said second ponchos are prohibited from prematurely and undesirably separating during operating conditions.

9. The combined multi-person and wheelchair protective covering of claim 8, wherein said adjusting means comprises:

a sleeve monolithically formed in a front edge of each of said hooded portions, said sleeve extending along an entire length of said front edge of said hooded portion.

10. The combined multi-person and wheelchair protective covering combination protective covering of claim 9, wherein said adjusting means further comprises:

a drawstring slidably interfitted within said sleeve of said hooded portion, said drawstring having a longitudinal length that is greater than a longitudinal length of said sleeve of said hooded portion, said drawstring for tightening said hooded portion about the user head and the caregiver head respectively during operating conditions.

11. A method for providing a barrier for a user and a caretaker employing an existing wheelchair in outdoor environments during inclement weather, said method comprising the steps of:

a. providing first and second ponchos, said first and second ponchos being formed from water-impermeable material such that precipitation is prohibited from penetrating therethrough;

b. attaching said second poncho to said first poncho;

c. adjusting each of said first and second ponchos about respective heads of the user and the caregiver; and d. securing each of said first and second ponchos respectively about the user body and the caregiver body and the existing wheelchair during operating conditions.

12. The method of claim 11, wherein step c. comprises the steps of:

i. providing an annular opening formed in a central region of a top surface of said body of said first and second ponchos respectively;

ii. penetrating the user head and the caregiver head respectively through said openings of said body of said first and second ponchos respectively;

iii. draping said body about the user shoulders and the caregiver shoulders respectively, said body extending downwardly and outwardly from the user and caregiver shoulders respectively;

iv. providing a flexible hooded portion monolithically formed with a rear edge of said annular openings of said first and second ponchos respectively, said hooded portion extending upwardly and away from said top surface of said body of said first and second ponchos respectively; and v. introducing the user head and the caregiver head respectively into an interior of said hooded portion, said hooded portion simultaneously contacting and surrounding a major portion of the user head and the caregiver head respectively during operating conditions.

13. The method of claim 12, wherein step b. comprises the step of:

i. providing a plurality of snap closures spaced along a rear edge of said first poncho and a front edge of said second poncho respectively; and ii. connecting each of said snap closures of said first poncho directly to an associated one of said snap closures of said second poncho such that said first and said second ponchos are prohibited from prematurely and undesirably separating during operating conditions.

14. The method of claim 13, wherein step c. further comprises the steps of:

vii. providing a sleeve monolithically formed in a front edge of each of said hooded portions, said sleeve extending along an entire length of said front edge of said hooded portions.

15. The method of claim 14, wherein step c. further comprises the steps of:

i. interfitting a drawstring within said sleeve of said hooded portion, said drawstring having a longitudinal length that is greater than a longitudinal length of said sleeve of said hooded portion; and ii. tightening said drawstring of said hooded portion about the user head and the caregiver head respectively during operating conditions.

16. The method of claim 15, wherein step d. comprises the steps of:

i. providing a plurality of snap closures spaced along respective right and left laterally opposed edges of said first and second ponchos;

ii. connecting selected ones of said left snap closures of said first poncho directly to associated ones of said left snap closures of said first poncho;

iii. connecting selected ones of said right snap closures of said first poncho independently and directly to associated ones of said right snap closures of said first poncho;

iv. connecting selected ones of said left snap closures of said second poncho directly to associated ones of said left snap closures of said second poncho; and v. connecting said right snap closures of said second poncho independently and directly to associated ones of said right snap closures of said second poncho;

wherein the user and the caregiver respectively connect said right and left snap closures as desired about the user and the caregiver and the existing wheelchair to prohibit sun and precipitation from contacting the user and the caregiver and the existing wheelchair during operating conditions.

* * * * *